United States Patent [19]

Sakae et al.

[11] 4,453,512

[45] Jun. 12, 1984

[54] ENGINE OVERHEAT PREVENTION SYSTEM

[75] Inventors: Mitsuhisa Sakae, Kamakura; Masaharu Hattori, Tokyo, both of Japan

[73] Assignee: Kabushiki Kaisha Komatsu Seisakusho, Tokyo, Japan

[21] Appl. No.: 372,003

[22] Filed: Apr. 26, 1982

[51] Int. Cl.[3] ..... F02B 77/08

[52] U.S. Cl. ..... 123/198 D; 123/41.15; 123/196 S; 123/198 DB; 60/716

[58] Field of Search ..... 123/198 D, 198 DB, 379, 123/196 S, 41.15; 60/716, 718

[56] References Cited

U.S. PATENT DOCUMENTS

| | | | |
|---|---|---|---|
| 2,867,199 | 1/1959 | Holbrook | 123/379 |
| 4,102,316 | 7/1978 | Valbert | 123/198 DB |
| 4,106,470 | 8/1978 | Saizar | 123/198 DB |
| 4,129,040 | 12/1978 | Hayden | 123/198 D |
| 4,150,654 | 4/1979 | Heitzman et al. | 123/198 D |
| 4,175,530 | 11/1979 | Asano | 123/379 |
| 4,195,610 | 4/1980 | Bastenhof | 123/198 DB |
| 4,212,278 | 7/1980 | Eisinger et al. | 123/198 DB |
| 4,252,090 | 2/1981 | Baugh | 123/379 |
| 4,338,896 | 7/1982 | Papasideris | 123/198 DB |

*Primary Examiner*—Ira S. Lazarus

*Attorney, Agent, or Firm*—Armstrong, Nikaido, Marmelstein & Kubovcik

[57] ABSTRACT

A system for preventing engine overheat in a vehicle such as a motor scraper or the like having a front engine and a rear engine mounted thereon. An actuator is operatively connected to the rear engine for controlling speed thereof and also is connected to a source of pressurized fluid through a solenoid-operated valve. A plurality of detectors are mounted in the rear engine each detecting a preset abnormal condition of the rear engine. Provided in the system is a relay responsive to a signal from the detectors for simultaneously turning on a warning lamp and energizing the solenoid-operated valve thereby blocking communication between the source of pressurized fluid and the actuator, thereby reducing the speed of the rear engine to its idle speed.

4 Claims, 1 Drawing Figure

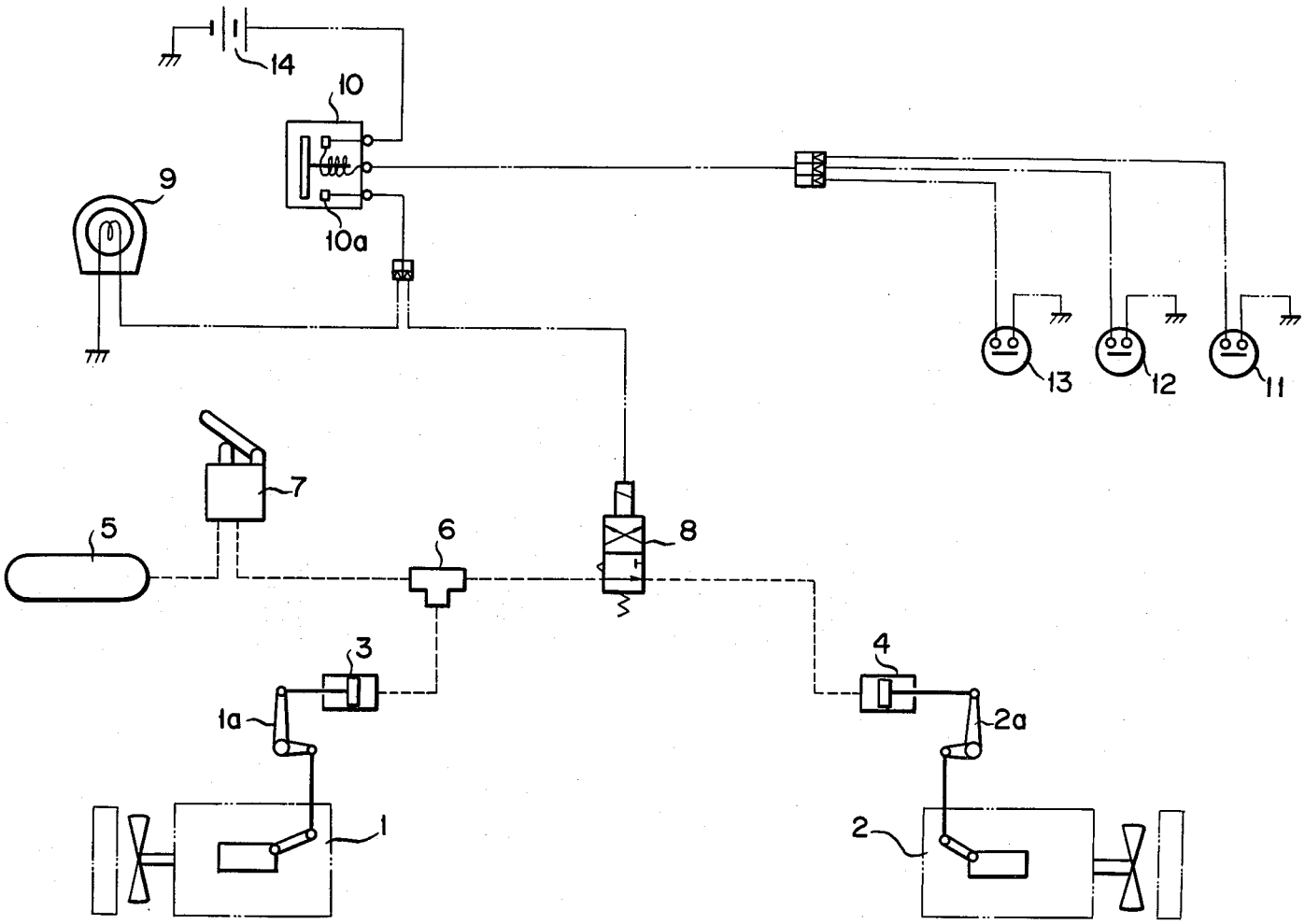
11
12
13
2a
4
2
8
6
3
1
1a
10
10a
14
7
9
5

ENGINE OVERHEAT PREVENTION SYSTEM

BACKGROUND OF THE INVENTION

This invention relates to a system for preventing the overheating of rear engine for use in a motor-scraper or the like with engines mounted on the front and rear portions of the vehicle body.

In general, motor-scrapers with engines mounted on the front and rear portions of the vehicle body are disadvantageous in that the rear engine is poorer in ventilation than the front engine. Furthermore, the rear engine draws therein the air which has cooled the front engine and consequently is heated to an elevated temperature as the cooling air therefor so that it tends to be overheated.

SUMMARY OF THE INVENTION

It is therefore an object of the present invention to provide an engine overheat prevention system in a motor scraper or the like having a front and a rear engine mounted thereon wherein the overheat of the rear engine can be effectively prevented.

Another object of the present invention is to provide an engine overheat prevention system in a motor scraper or the like wherein not only a warning lamp is turned on when an abnormal condition of the rear engine is detected but also the rear engine is automatically controlled to an idling speed.

In accordance with an aspect of the present invention, there is provided a system for preventing engine overheat in a vehicle having first and second engines mounted on front and rear end portions thereof; comprising: actuator means for controlling the rotational speed of the second engine; a source of pressurized fluid; solenoid-operated valve means disposed in a circuit between said source of pressurized fluid and said actuator means, said solenoid-operated valve means being normally open and adapted to be closed when actuated; a plurality of detector means mounted in said engine each detecting a preset abnormal condition of said second engine; a warning lamp mounted on the vehicle; and means responsive to a signal from said detector means for simultaneously actuating said solenoid-operated valve means and turning on said warning lamp.

The above and other objects, features and advantages of the present invention will be readily apparent from the following description taken in conjunction with the accompanying drawing.

BRIEF DESCRIPTION OF THE DRAWING

Attached drawing shows an overall circuit for an engine overheat prevention system according to the present invention.

DESCRIPTION OF THE PREFERRED EMBODIMENT

The present invention will now be described in detail below by way of example only with reference to the accompanying drawing. In the drawing, reference numeral 1 denotes a front engine mounted on the front part of the vehicle body of a motor-scraper not shown and 2 a rear engine mounted on the rear part thereof, the arrangement being made such that the revolutions of the engines 1 and 2 may be controlled by operating throttle levers 1*a* and 2*a*, respectively, by means of respective air cylinders 3 and 4. Reference numeral 5 indicates an air reservoir which supplies air through a flow divider valve 6 into each of air cylinders 3 and 4. Interposed between the air reservoir 5 and the flow divider valve 6 is an air control valve 7 adapted to control the amount of air to be supplied into the air cylinders 3 and 4, whilst interposed between the flow divider valve 6 and the air cylinder 4 is a solenoid valve 8 adapted to be actuated by a signal representative of an abnormal condition to interrupt the circuit. The solenoid valve 8 and an overheat indicating lamp 9 are connected with a contact 10*a* of a relay 10.

Electrically connected with the relay 10 are a cooling water temperature detector 11, a cooling water level detector 12 and a torque converter's hydraulic oil temperature detector 13, all of them being installed on the rear engine, so that the relay 10 may be energized by a signal representative of abnormality detected by any of the detectors 11, 12 and 13. Reference numeral 14 denotes a power supply.

Since the present invention is constructed as mentioned in detail hereinabove, if, during the running of the motor-scraper, an abnormality occurs in the cooling water temperature or water level or the like in the rear engine 2 and is detected by any of the detectors 11, 12 and 13, the relay 10 will be energized by a signal representative of the abnormality to allow the contact 10*a* to be constructed with the power supply 14 thereby illuminating the overheat indicating lamp 9 to give the driver a warning for overheating, and at the same time allowing the solenoid valve 8 to be shut off to interrupt the supply of air into the air cylinder 4 so that the rear engine 2 may be automatically decelerated to its low idle run. Therefore, even if the driver continues the scraping operation without taking notice of the warning by the illuminated overheat indicating lamp, the overheating of the rear engine 2 can be eliminated without fail.

What is claimed is:

1. An engine control system for a vehicle having first and second engines mounted on the front and rear ends thereof, respectively, comprising:

first and second pressurized fluid control means connected to said first and second engines, respectively, for controlling the speed thereof in accordance with the fluid pressure applied;

a source of pressurized fluid;

a control valve connected by fluid lines to said source of pressurized fluid and to said first and second control means for controlling the speed of both said engines;

a plurality of abnormal condition detector means mounted in said second engine;

solenoid operated valve means positioned in the fluid line between said control valve and said second pressurized fluid control means; and means responsive to operation of any one of said abnormal condition detector means for actuating said solenoid operated valve means to shut off the supply of fluid from said control valve to said second pressurized fluid control means, thereby reducing the speed of said second engine to its idle speed.

2. An engine control system as claimed in claim 1, further comprising a warning device connected to said means responsive to operation of any one of said abnormal condition detector means, and operable thereby to warn the vehicle operator of acuation of said means.

3. An engine control system as claimed in claim 2, wherein said means responsive to said abnormal condition detector means includes a relay having its operating coil connected to said abnormal condition detector means and operating to connect said solenoid operated valve means to a power supply.

4. An engine control system as claimed in claim 1, wherein said abnormal condition detector means include a cooling water temperature detector, a hydraulic oil temperature detector and a cooling water level detector.

* * * * *